US011384524B2

(12) United States Patent
Pospisil et al.

(10) Patent No.: US 11,384,524 B2
(45) Date of Patent: Jul. 12, 2022

(54) BELOW-GRADE MODULAR ASSEMBLY

(71) Applicant: United States Gypsum Company, Chicago, IL (US)

(72) Inventors: Frank Pospisil, Oak Park, IL (US); Breton Betz, Centennial, CO (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 0 days.

(21) Appl. No.: 16/572,048

(22) Filed: Sep. 16, 2019

(65) Prior Publication Data

US 2020/0141109 A1 May 7, 2020

Related U.S. Application Data

(60) Provisional application No. 62/755,418, filed on Nov. 2, 2018.

(51) Int. Cl.

| | |
|---|---|
| ***E04B 1/00*** | (2006.01) |
| ***E02D 27/32*** | (2006.01) |
| ***E04B 1/348*** | (2006.01) |

(52) U.S. Cl.

CPC ..... *E04B 1/0015* (2013.01); *E02D 27/32* (2013.01); *E04B 1/3483* (2013.01); *E04B 1/34838* (2013.01)

(58) Field of Classification Search

CPC .. E04B 1/3483; E04B 1/34838; E04B 1/0007; E04B 1/0015; E02D 27/32; E02D 17/13; E02D 27/016; E02D 27/10; E02D 27/00

See application file for complete search history.

(56) References Cited

U.S. PATENT DOCUMENTS

| | | | | |
|---|---|---|---|---|
| 1,045,078 A | | 11/1912 | Proctor | |
| 2,915,150 A | * | 12/1959 | Weidler | E02D 17/04 52/269 |
| 3,500,595 A | * | 3/1970 | Bennett | E04C 3/30 52/79.13 |
| 4,222,208 A | | 9/1980 | Ferver | |
| 4,457,118 A | * | 7/1984 | Bowen | E04B 1/0007 52/292 |

(Continued)

FOREIGN PATENT DOCUMENTS

| | | |
|---|---|---|
| DE | 3132652 A1 | 8/1982 |
| DE | 102005052181 A1 | 5/2007 |

(Continued)

OTHER PUBLICATIONS

Technology in Architecture, Glass fiber reinforced concrete Oct. 2018 (Year: 2018).*

(Continued)

*Primary Examiner* — Adriana Figueroa

(74) *Attorney, Agent, or Firm* — Greer, Burns & Crain, Ltd.; Philip T. Petti; Pradip Sahu

(57) ABSTRACT

A modular assembly is provided and includes a modular frame to be installed at least partially below grade and at least two panels attached to the modular frame, where the at least two panels are made of a material that withstands lateral, vertical and shear forces generated by surrounding below grade materials. The modular frame and the at least two panels are joined together as a unit prior to installation.

16 Claims, 9 Drawing Sheets

(56) References Cited

U.S. PATENT DOCUMENTS

| | | | | |
|---|---|---|---|---|
| 4,504,320 | A * | 3/1985 | Rizer | C04B 28/04 106/676 |
| 4,638,607 | A | 1/1987 | Hadjiiski et al. | |
| 4,641,477 | A | 2/1987 | Schleck | |
| 4,759,158 | A | 7/1988 | Aubry | |
| 5,199,233 | A | 4/1993 | Fukutomi et al. | |
| 5,331,782 | A * | 7/1994 | Wohlgemuth | E02D 27/00 52/169.14 |
| 5,412,913 | A | 5/1995 | Daniels et al. | |
| 6,484,460 | B2 * | 11/2002 | VanHaitsma | E02D 27/01 52/274 |
| 7,594,361 | B2 | 9/2009 | Ruano | |
| 7,827,738 | B2 | 11/2010 | Abrams et al. | |
| 8,065,845 | B1 | 11/2011 | Sorkin | |
| 8,065,846 | B2 | 11/2011 | McDonald et al. | |
| 8,307,608 | B2 * | 11/2012 | Harig | B67D 7/0272 52/481.1 |
| 8,484,929 | B1 * | 7/2013 | Begdouri | E02D 29/045 52/745.03 |
| 9,115,504 | B2 | 8/2015 | Wallance | |
| 9,458,618 | B1 | 10/2016 | Woznuk | |
| 2004/0154238 | A1 * | 8/2004 | Stichter | E04B 1/34336 52/143 |
| 2005/0066589 | A1 | 3/2005 | Bedell et al. | |
| 2005/0076611 | A1 * | 4/2005 | Crawford | E04B 1/80 52/782.1 |
| 2016/0160515 | A1 | 6/2016 | Wallance | |

FOREIGN PATENT DOCUMENTS

| | | | | |
|---|---|---|---|---|
| GB | 1262521 | A | 2/1972 | |
| GB | 2136468 | A * | 9/1984 | B32B 13/12 |
| JP | H02104821 | A | 4/1990 | |
| JP | H0427077 | A | 1/1992 | |
| RU | 176779 | U1 | 1/2018 | |
| WO | 2004099515 | A1 | 11/2004 | |
| WO | 2014074508 | A1 | 5/2014 | |

OTHER PUBLICATIONS

PCT International Search Report and Written Opinion for PCT Application No. PCT/US2019/059080 dated Apr. 17, 2020 (15 pages).

* cited by examiner

BELOW-GRADE MODULAR ASSEMBLY

BACKGROUND

The present invention relates generally to modular construction techniques for erecting multi-story residences, and more specifically to a modular assembly for below-grade construction for buildings.

Residential and commercial buildings need a foundation to shoulder the considerable weight of the building materials, provide a flat and level base for construction, and separate wood-based materials from contact with the ground, which would cause them to rot and be infested by termites.

Foundations are commonly constructed with concrete. First, a hole corresponding to the size of the foundation is dug in the ground to a desired depth based on the size and height of the area of the building that is below grade, such as a basement or crawl space. Once the dirt is removed, inner and outer forms made out of wood or steel, are erected along the perimeter of the building and are spaced apart based on the designated thickness of the foundation walls. After concrete is poured in the space between the inner and outer forms and sets, the inner and outer forms are removed to reveal the foundation. Next, additional forms are erected on the foundation to form the walls of the below-grade area. Installing the forms, pouring the concrete, allowing the concrete to set and then removing the forms takes several days and sometimes weeks. This adds significant time to the overall construction schedule for residential and commercial buildings as well as increases the construction costs.

It is a growing trend to construct multi-story residential buildings, using modular units, especially in crowded urban areas where heavy construction equipment has difficulty maneuvering. Modular construction reduces material waste, and since the units are assembled indoors at remote locations, labor costs and working conditions are more closely controlled. Such modules are remotely constructed and assembled, transported to the building site, then placed in position using a crane. Many modules are as long as 75 feet and are assembled by stacking the modules vertically, side-by-side and end-to-end, thus providing a variety of configurations of a final building design. These modules, however, are typically made of lightweight materials that are typically not structurally strong enough for the vertical, lateral and shear forces applied to the foundation and below-grade walls by the surrounding dirt and by the weight of the building materials used to construct the floor or floors built above the below-grade area.

Thus, there is a need for a modular assembly for below-grade structures of residential and commercial buildings.

SUMMARY

The above-listed need is met or exceeded by the present modular assembly that is configured to be installed below grade and support one or more floors of a residential or commercial building. To save time and costs, the modular assembly is manufactured at a remote location and transported to a site for quick and easy installation in a below grade open area formed in the ground.

In an embodiment, a modular assembly is provided and includes a modular frame to be installed at least partially below grade and at least two panels attached to the modular frame, where the at least two panels are made of a material that withstands lateral, vertical and shear forces generated by surrounding below grade materials. The modular frame and the at least two panels are joined together as a unit prior to installation.

In another embodiment, a modular system for below-grade installation is provided and configured to support a multi-story building. The system includes at least two modular assemblies secured together as a unit, where each of the modular assemblies is configured to be installed at least partially below grade. The modular assemblies each include a modular frame and at least two panels attached to the modular frame, where the at least two panels are made of a material configured to withstand lateral, vertical and shear forces generated by surrounding below grade materials, and where the modular frame and at least two panels are joined together as a unit prior to installation.

In a further embodiment, a method of forming a modular assembly for installation below grade is provided and is configured for supporting a building, where the method includes attaching at least two panels to a modular frame at a remote location. The at least two panels are made of a material that withstands lateral, vertical and shear forces generated by surrounding below grade materials.

DETAILED DESCRIPTION

Figure 1:
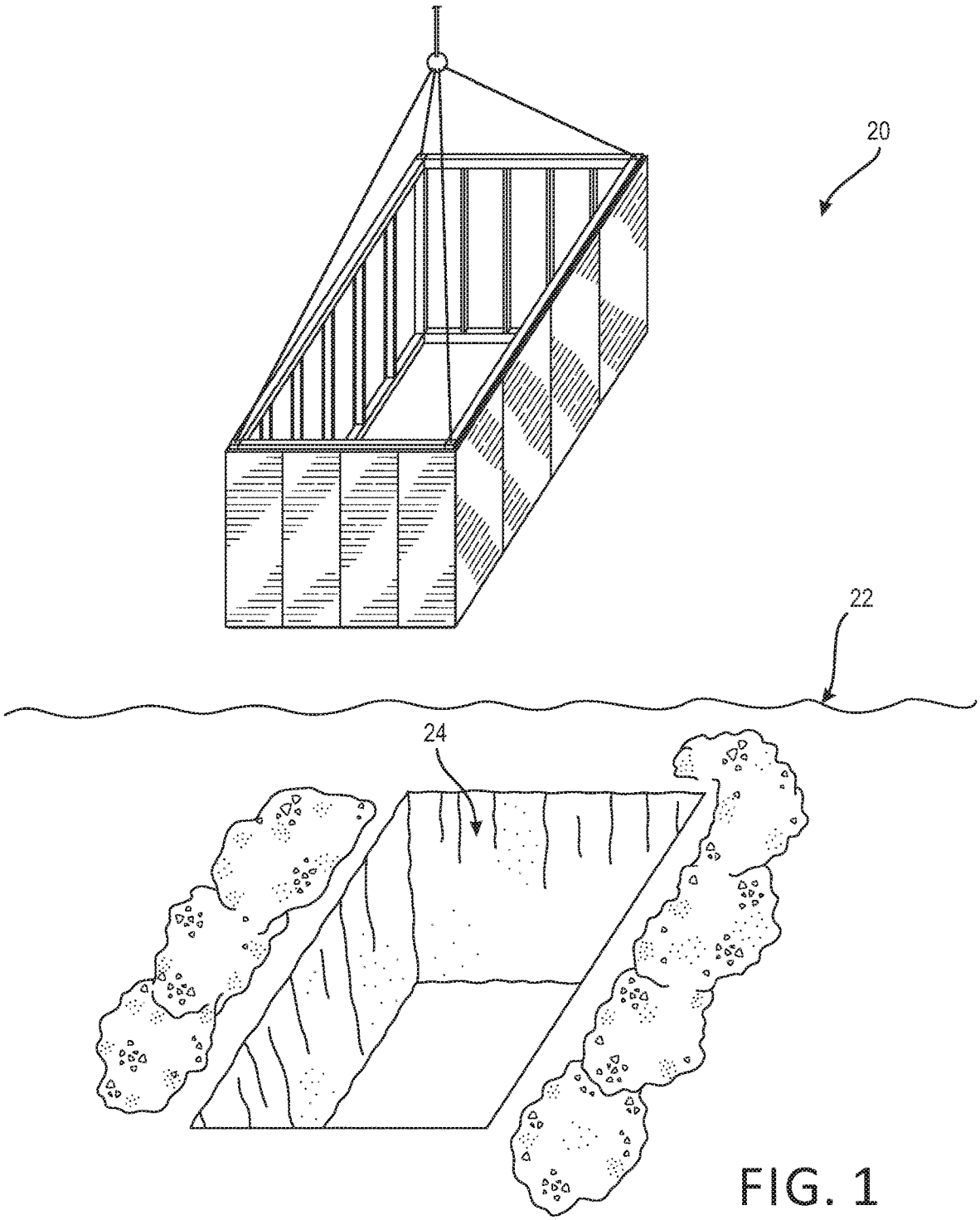
FIG. 1 is a schematic view of the present modular assembly being transported to a hole in the ground for a building.
Figure 2:
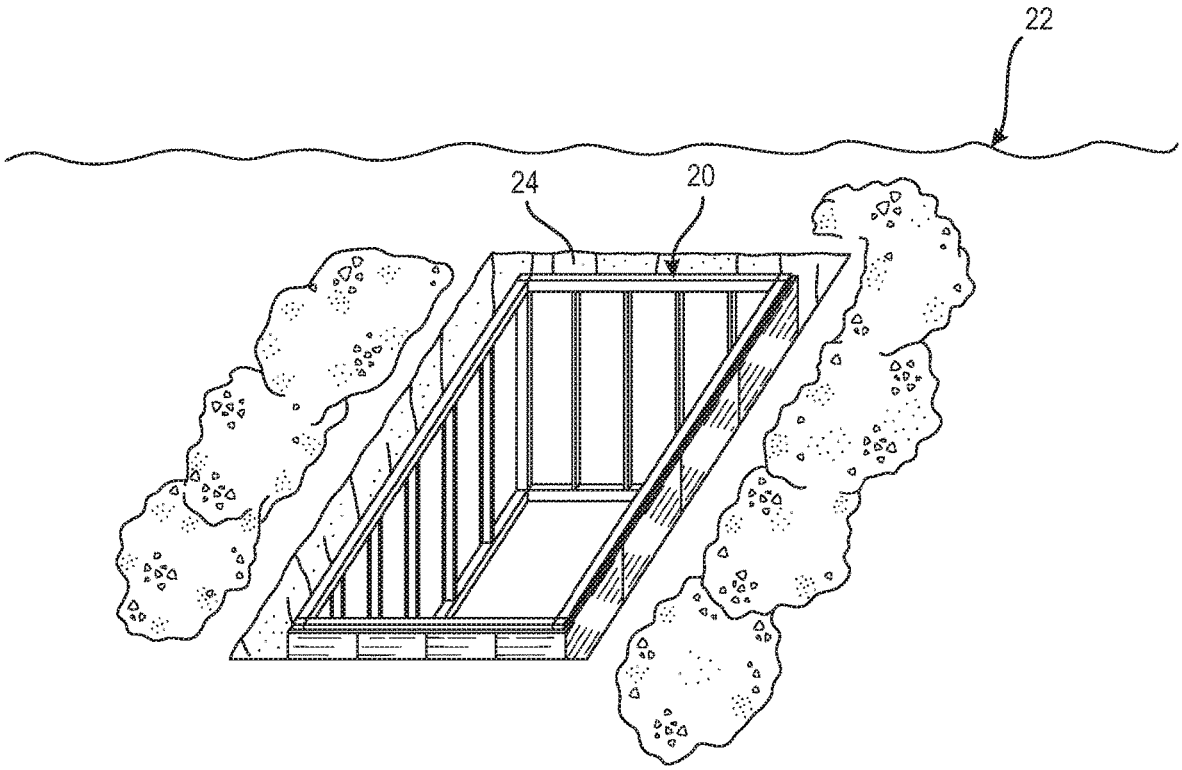
FIG. 2 is a schematic view of the present modular assembly inserted in the hole of FIG. 1.
Figure 3:
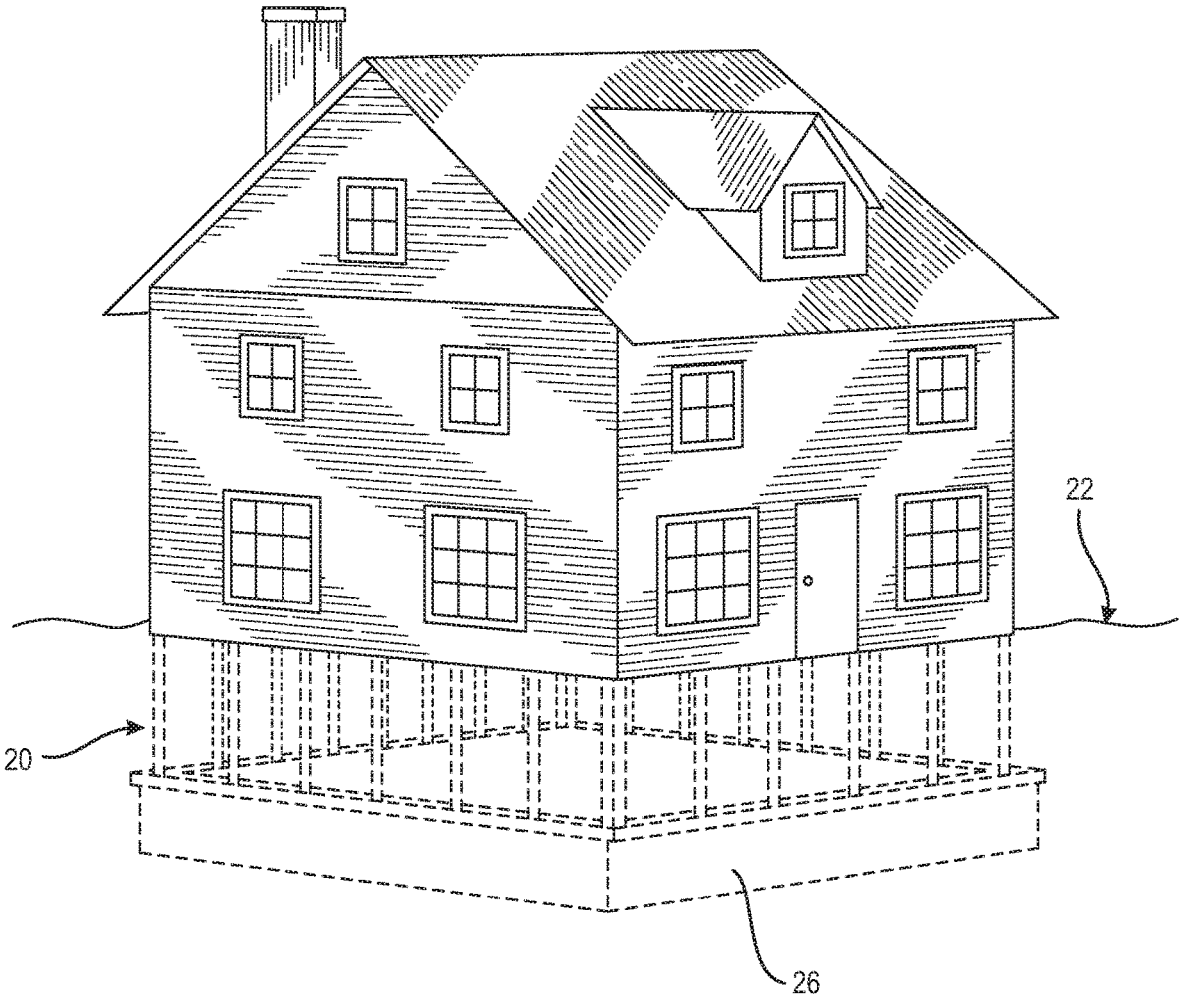
FIG. 3 is a schematic view of a residential building constructed on the modular assembly of FIG. 2.

Referring now to FIGS. 1-4, the present modular assembly 20 is constructed to be installed below ground level 22 for structural walls of an area that is below ground level or sub-grade, such as a basement, crawl space or cellar, of residential and commercial buildings. As shown in FIG. 1, the modular assembly 20 is constructed at a remote location and then transported as a modular unit to a work site. Typically, as described above, a foundation and structural walls of a building are formed with poured concrete, which takes significant time due to the installation and removal of forms and additional time to allow the concrete to set and harden. The present modular assembly 20 significantly decreases the preparation and installation time because the structural walls are pre-fabricated and assembled as a modular unit at a remote location. When the modular assembly 20 arrives at a work site, it is positioned in a hole or area 24 dug for a building as shown in FIGS. 1 and 2. The modular assembly 20 may be positioned or placed on a foundation 26 as shown in FIG. 3 or on gravel or other sub-surface depending on the type of building being constructed.

Figure 4:
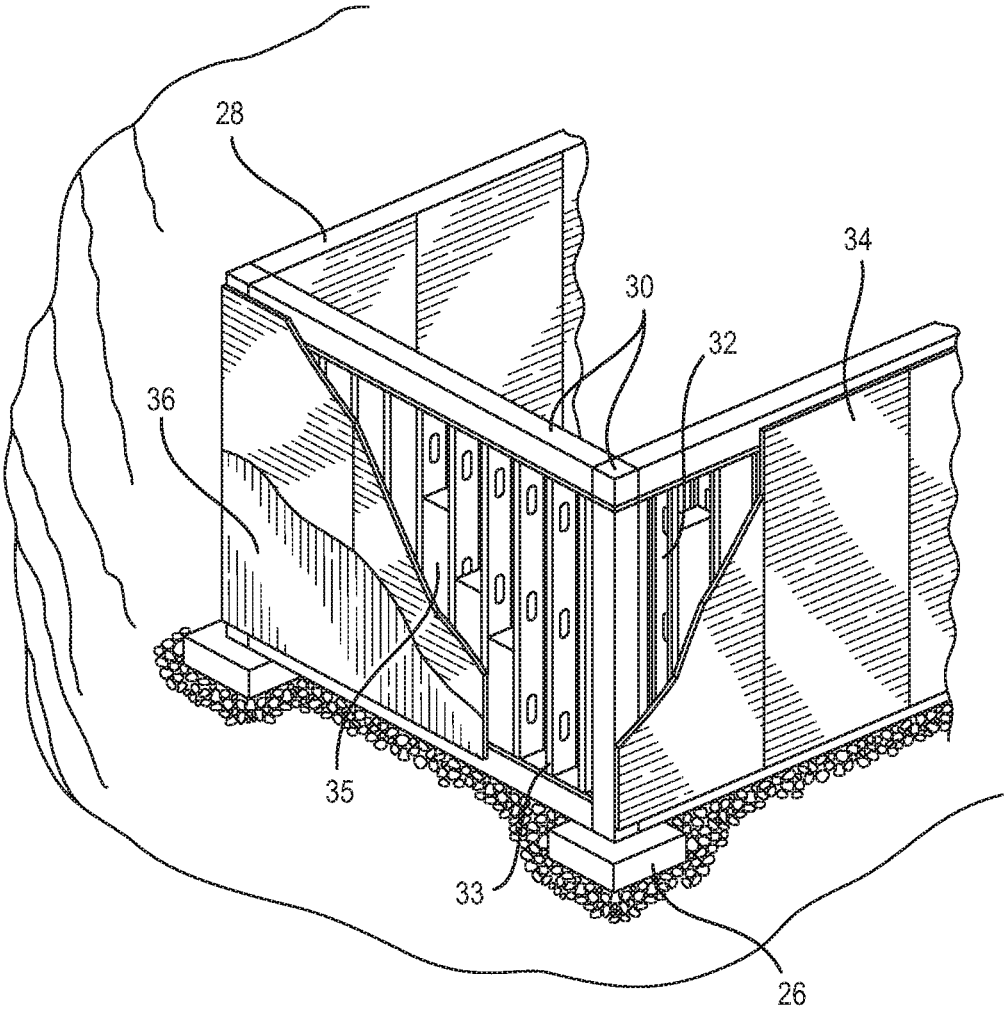
FIG. 4 is an enlarged, fragmentary perspective view of a wall of the present modular assembly on a foundation wall.
Figure 5:
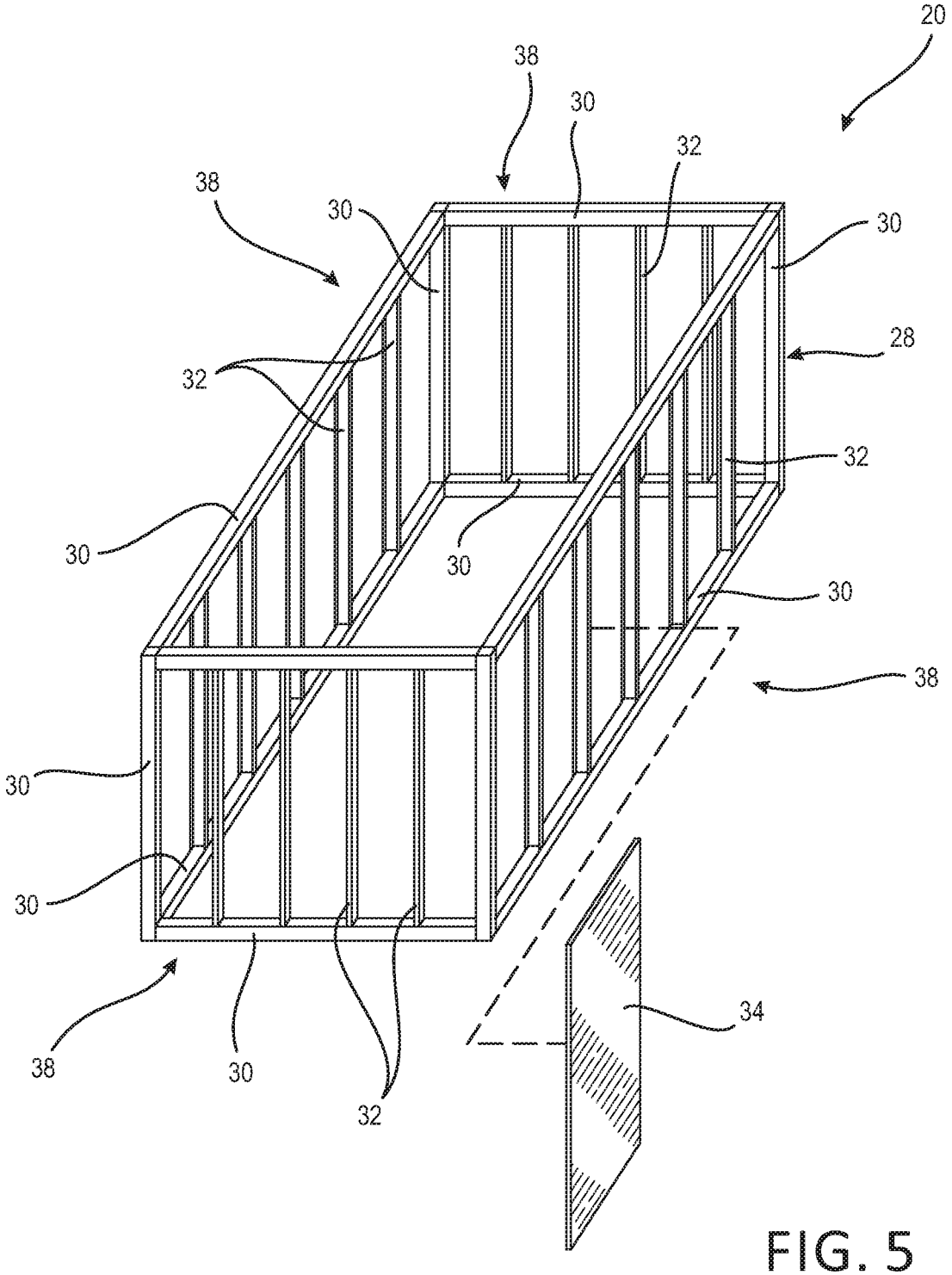
FIG. 5 is an exploded perspective view of the modular assembly of FIG. 1 showing a modular frame and a panel.

Referring to FIGS. 4-5, the modular assembly 20 includes a modular frame 28 made of primary structural supports 30 and secondary structural supports 32. The primary structural supports 30 are connected together by suitable fasteners to form the outer structure of the modular frame 28. In the illustrated embodiment, the primary structural supports 30 are made of iron, but may be made with another metal, wood or any suitable material. Also, the primary structural supports 30 are preferably two inch by twelve inch supports with a designated length but may have any suitable thicknesses, dimensions and length. In FIG. 5, the outer structure is made with individual primary structural supports 30. Alternatively, two or more of the primary structural supports 30 may be connected together at the top, bottom or sides of the outer structure to enhance the strength and rigidity of the modular frame 28.

After the outer structure of the modular frame 28 is assembled, a plurality of secondary structural supports 32, i.e., studs, are attached between the upper and lower ends of the modular frame 28 to form the walls of the modular assembly 20. The secondary structural supports 32 are preferably two inches by eight inches and a desired length but may have any suitable thicknesses, dimensions and length. Also, the secondary structural supports 32 are made of cold-formed steel, but may be made with wood or any suitable material. In an embodiment, the secondary structural supports 32 may be attached between the walls at the upper end, lower end or both the upper and lower ends of the outer structure as structural support for installing a floor, a ceiling or both a floor and ceiling on the modular assembly 20.

When the construction of the modular frame 28 is finished, a plurality of sub-grade panels 34 (FIG. 5) are attached to the outer surface 33 (FIG. 4) of the modular frame 28. It should be appreciated that one or more of the panels 34 may be attached to the modular frame 28. Preferably, at least two of the panels 34 are attached to the modular frame 28 to form a desired modular assembly 20. In the illustrated embodiment, each of the panels 34 is attached to the modular frame 28 using suitable fasteners, such as screws, that are driven through the outer surface of the panels and into the primary and/or secondary structural supports 30, 32 of the modular frame 28 to secure the panels to the modular frame. Alternatively, the fasteners may be inserted through the primary and secondary structural supports 30, 32 and then into the interior surfaces of the panels 34 to secure the panels to the modular frame 28.

In the illustrated embodiment, the sub-grade panels 34 are made of a fiber-glass reinforced cementitious material that is non-rotting, termite-resistant, mold-resistant and moisture-resistant (change in moisture content of less than 10%). Further, the material used to form the panels 34 is stable, i.e., the panel will not buckle or warp like conventional wood sheathing, non-combustible and dimensionally stable and strong to support backfill loads of 2000 pounds per square foot and greater, and to carry shear and gravity loads. Preferably, each panel 34 is configured to support a uniform lateral load of up to 2083 pounds per square foot when is the secondary structural supports 32 are spaced 12 inches apart and shear wall design ratings (shear strengths) of up to 1726 pounds per linear foot. In the illustrated embodiment, the panels 34 each have a width of 4 feet and a length of 8 feet with a thickness of ¾ (0.75) inches. The panels 34 may also have a thickness of ⅝ (0.625) inches. It should be appreciated that the panels 34 may have any suitable width, length and thickness based on desired construction specifications. Additionally, each panel 34 has a weight of 5 pounds per square foot, which is significantly less than the weight of concrete walls used for conventional below-grade areas of residential and commercial buildings. The lighter weight of the panels 34 also makes transport and installation of the modular assemblies 20 easier and less expensive.

In an embodiment, the physical and mechanical properties of the sub-grade panels 34 are described in the following table:

| | TEST STANDARD (ASTM NO.) | CONCRETE FOUNDATION WALL VALUES | CONCRETE FOUNDATION WALL XD VALUES |
|---|---|---|---|
| Fastener Lateral Resistance[1] | D1761 | DRY > 210 lbs. [0.93 kN]<br>WET > 160 lbs. [0.71 kN] | DRY > 210 lbs. [0.93 kN]<br>WET > 160 lbs. [0.71 kN] |
| Density - Oven Dried[2] | C1185 | 75 lb/ft$^3$ [1200 kg/m$^3$] | 75 lb/ft$^3$ [1200 kg/m$^3$] |
| Weight: ¾ Inch Thickness Delivered | D1037 | 5.3 lb/ft$^3$ [25.9 kg/m$^2$] | 5.3 lb/ft$^3$ [25.9 kg/m$^2$] |
| pH Value | D1293 | 10.5 | 10.5 |
| Liner Variation with Change in Moisture (25-90% Relative Humidity) | C1185 | <0.10% | <0.10% |
| Thickness Swell | D1037 | Max 3.0% | Max 3.0% |
| Freeze/Thaw Resistance | C1185 | Passed 50 cycles | Passed 50 cycles |
| Mold Resistance | D3273/G21 | 10/0 | 10/0 |
| Water Absorption[3] | C1185 | <15.0% | <15.0% |
| Noncombustibility | E136 | Passed | Passed |
| Surface Burning Characteristics | E84 | 0 Flame Spread<br>Smoke Developed Index 0 | 0 Flame Spread<br>Smoke Developed Index 0 |
| Long Term Durability | C1185 | Min. 75% Retention of Physical Properties | 100% Retention of Physical Properties |
| Water Durability | C1185 | Min. 70% Retention of Physical Properties | 91% Retention of Physical Properties |
| Water Vapor Transmission (Method B) | E96 | Permeance < 2 Perm | Permeance < 2 Perm |

Notes:

[1]Fastener Lateral Resistance Measured with Applicable Fasteners

[2]Density Measured at Equilibrium Conditioning per Section 5.2.3.1: Tested 28 Days After Manufacturing

[3]Absorption Measured from Equilibrium Conditioning Followed by Emersion in Water for 48 hours Additionally, in applications where plywood is typically used as on the exterior or interior of a wall, floor or ceiling, the sub-grade panels 34 may be used instead of plywood in accordance with the ANSI PWF-Specification and the CAN CSA S406 Specification.

As shown in FIG. 4, the modular assembly 20 is placed on a foundation 26, which may be one or more foundation walls or supports, where the entire assembly is at least partially below grade to form a sub-grade area, such as a basement, of a residential or commercial building. In this embodiment, a waterproof membrane or waterproof coating 36 is applied to the exterior surfaces of the modular assembly 20 to inhibit moisture and water from penetrating the panels 34 and the seams between the panels and entering the interior space of the modular assembly. Additionally, as described below, the interior portion of the walls of the modular assembly 20 may be finished with insulation 35 placed in the spaces formed between the primary and secondary structural supports, and/or interior panels, such as wallboard panels, attached to the inner surfaces of the primary and secondary structural supports. In another embodiment, the insulation 35 is placed on the exterior or outer surface of the modular assembly between the waterproof membrane/coating 36 and the surrounding backfill soil.

Figure 6:
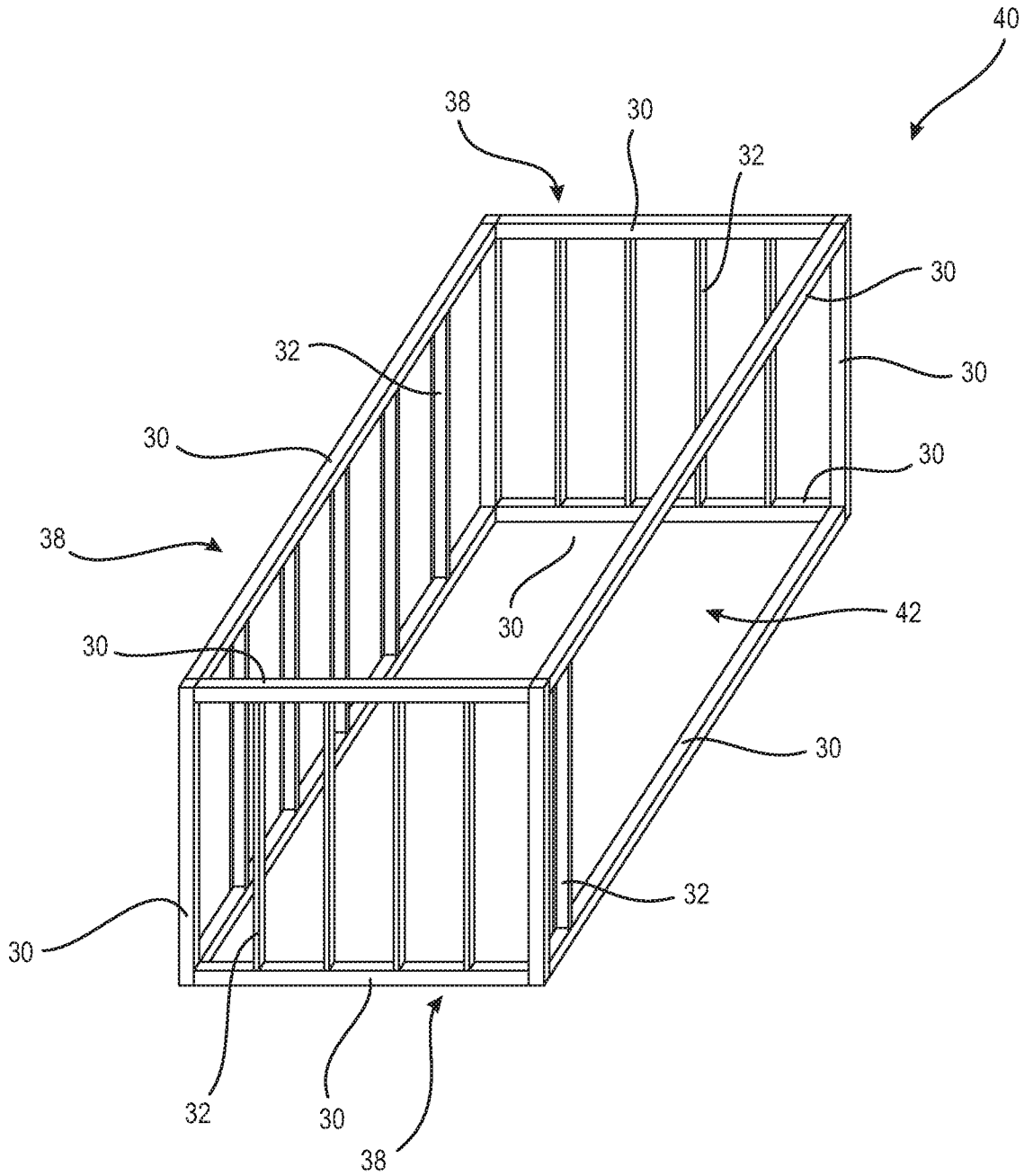
FIG. 6 is a perspective view of another embodiment of the present modular assembly where one side of the modular assembly is open.
Figure 7:
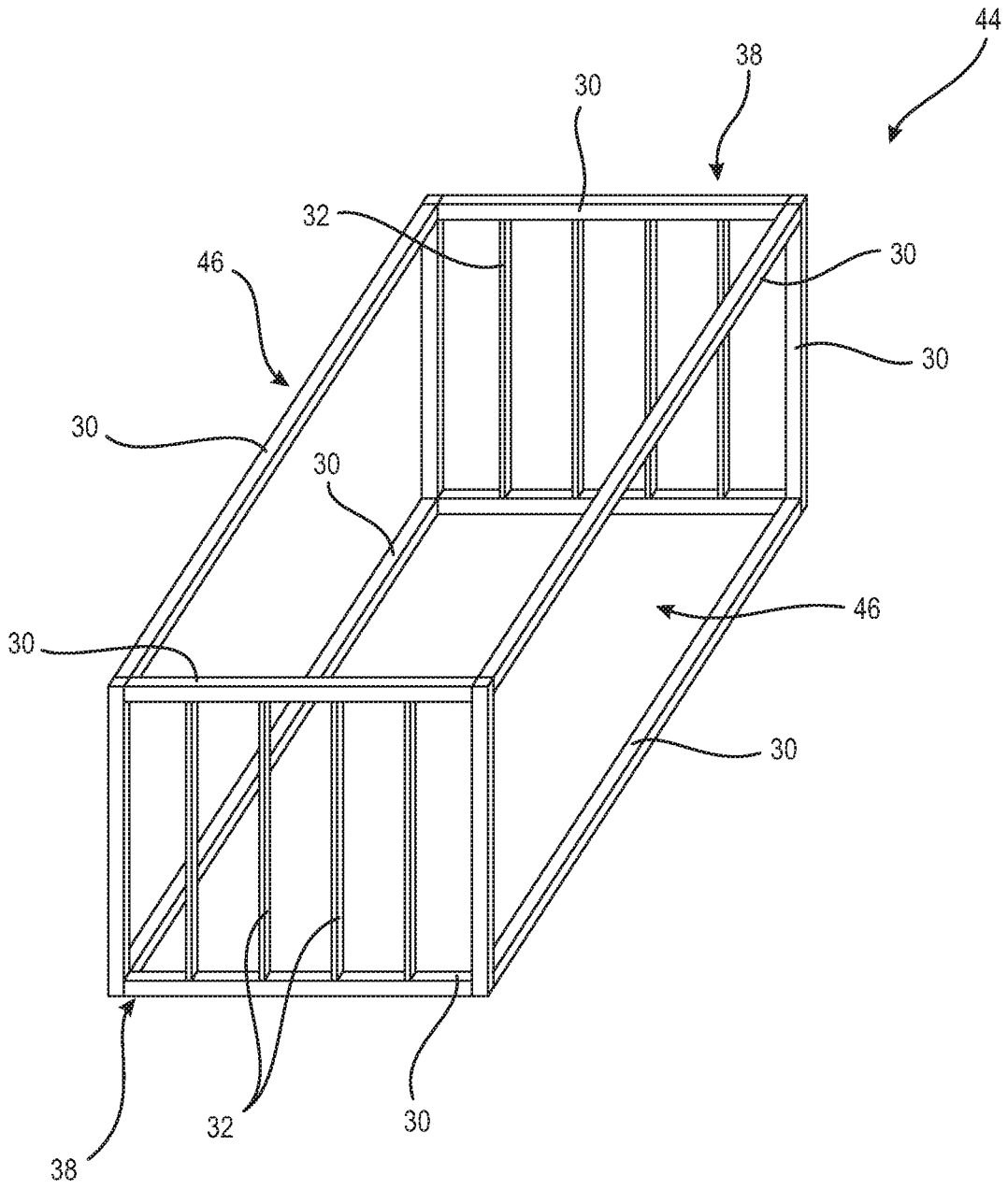
FIG. 7 is a perspective view of a further embodiment of the present modular assembly where two sides of the modular assembly are open.

Referring to FIGS. 5-7, each modular assembly 20 preferably includes at least four walls 38 made with the primary and secondary structural supports 30, 32 as described above. A plurality of the panels 34 are attached to the modular assembly 20 to form a modular structure having solid outer walls. The modular assembly 20 shown in FIG. 5 has a rectangular shape but it is contemplated that the modular assembly may have any suitable shape or combination of shapes. FIGS. 6 and 7 show different embodiments of the modular assembly. For example, FIG. 6 shows a modular assembly 40 having one open side 42, i.e., there are no secondary structural supports or panels attached to this side of the modular assembly. This modular assembly 40 may be positioned adjacent to or connected to another modular assembly for form a large sub-grade area. It should be appreciated that two or more of the modular assemblies may be positioned adjacent to and/or connected together to form a larger modular assembly. In another alternative embodiment shown in FIG. 7, the modular assembly 44 has two open sides 46. It should be appreciated that one or more of the sides of the modular assembly may be open sides and/or a portion of the walls of the modular assembly may have openings, such as for windows, doorways or stairwells.

Typically, openings and holes are formed in structural below grade or sub-grade walls to enable water pipes, electrical pipes or other structures to extend through the walls. In conventional concrete walls, such openings and holes must be cut after the concrete has set. The cutting of the concrete walls requires a concrete blade and/or drill bit and generates a significant amount of dust that is hazardous to the person cutting the walls and also creates a lot of dust. The panels of the present modular assembly 20 are made to withstand the shear, lateral and vertical loads from the surrounding ground materials used as backfill, such as dirt, rock and gravel, and above grade construction while enabling conventional blades and drill bits, such as carbide-tipped blades and bits, to be used to cut openings and holes in the panels. In this way, the panels 34 of the below-grade modular assembly 20 are much easier to cut and generate significantly less dust.

Figure 8:
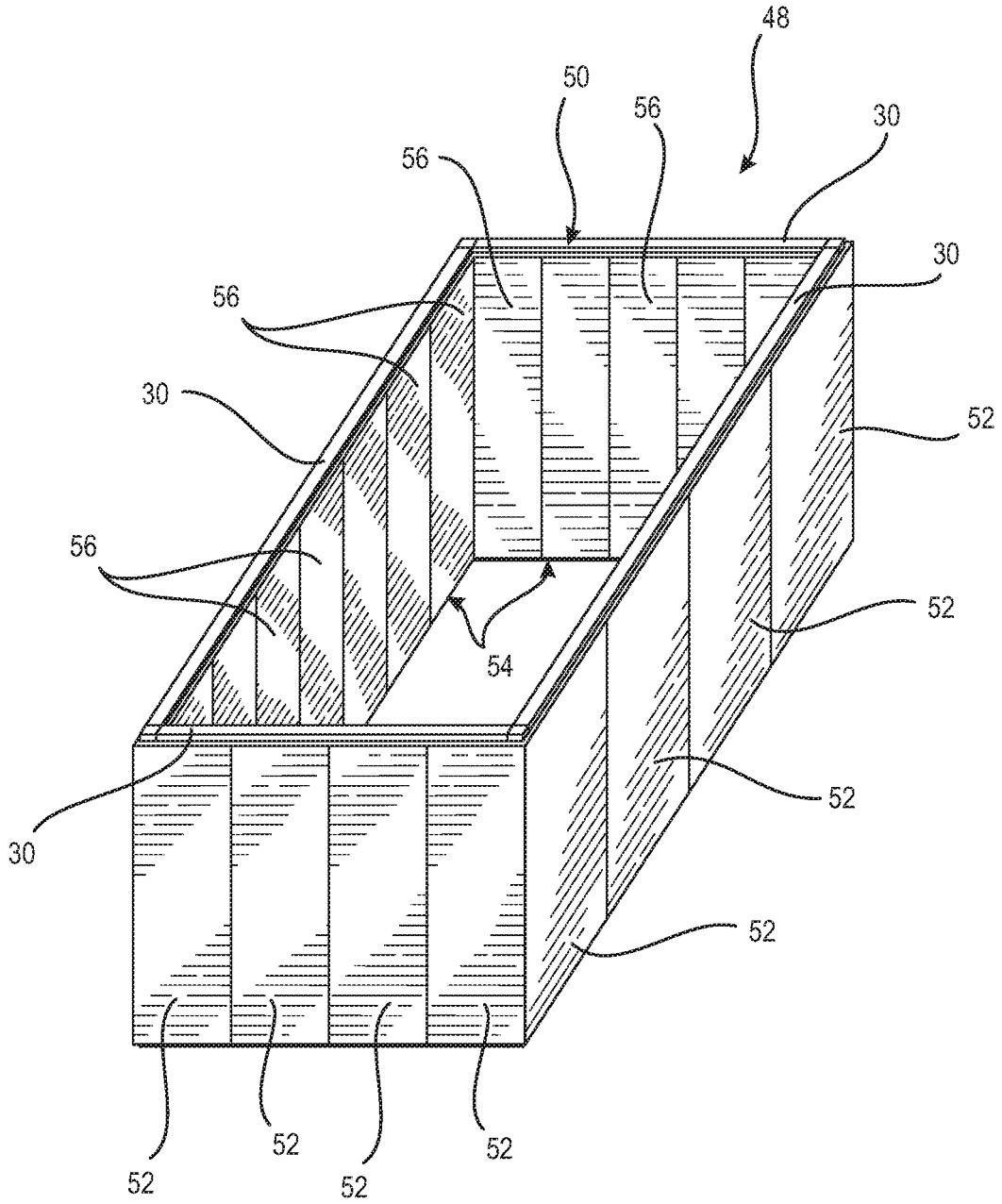
FIG. 8 is another embodiment of the present modular assembly that includes finished interior walls.

Referring to FIG. 8, in another embodiment, the modular assembly 48 includes a modular frame 50 and a plurality of panels 52 secured to the modular frame as described above. In this embodiment, the modular assembly 48 also includes a finished interior walls 54 having a plurality of wallboard panels 56 secured to the modular frame 50 adjacent to the inner surfaces of the panels 52. The finished interior walls 54 may also include tile, carpet or any suitable combination of finishing materials. In the illustrated embodiment, the seams of the wallboard panels 56 are taped and filled with joint compound and coated with at least a primer. It should be appreciated that the inner surfaces of the wallboard panels 56 may also be painted so that the modular assembly 48 is completely finished when it is installed on a foundation or other underlying surface.

Figure 9:
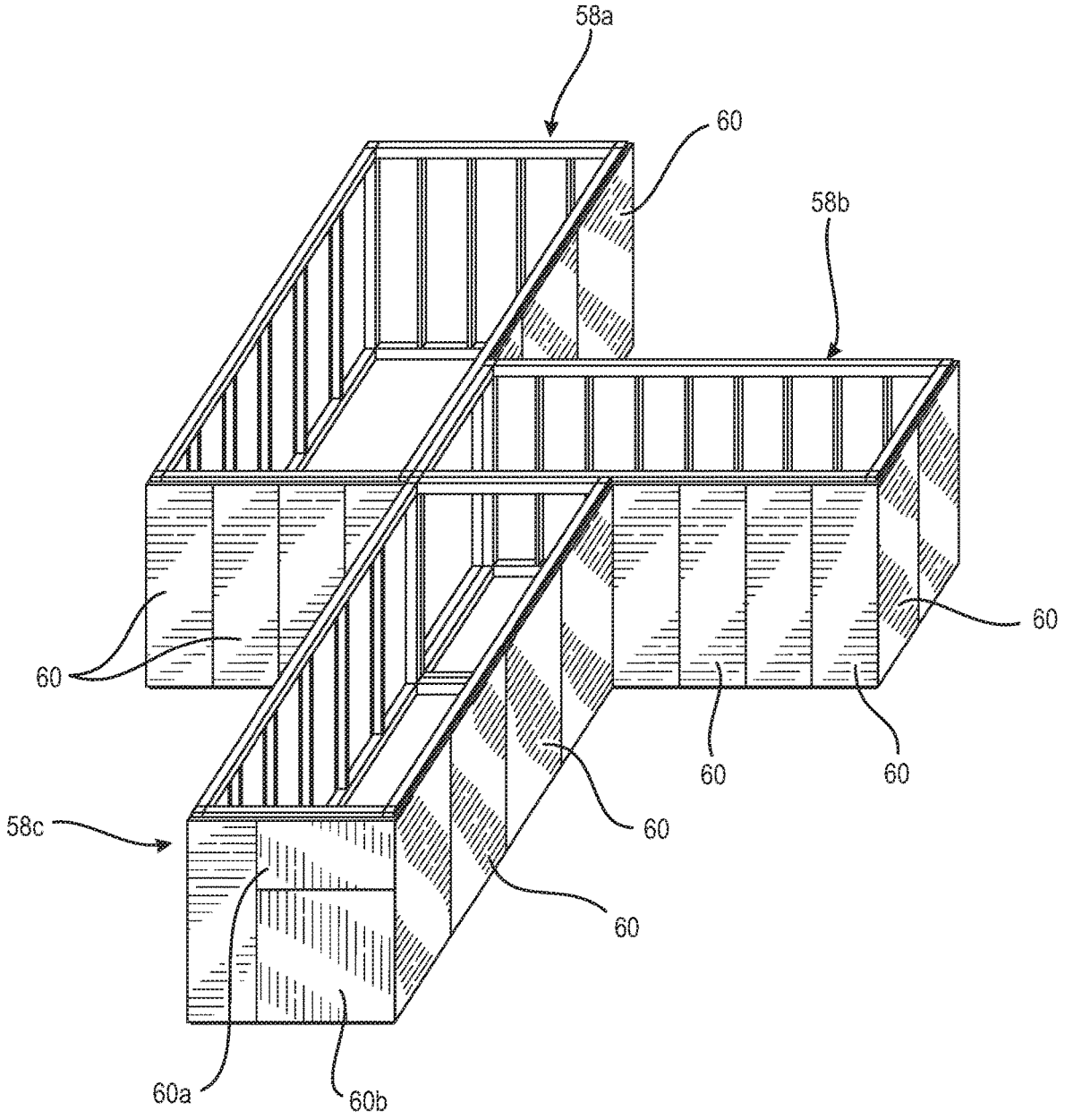
FIG. 9 is a further embodiment of the present modular assembly showing multiple modular assemblies positioned adjacent to each other.

Referring to FIG. 9, in a further embodiment, two or more modular assemblies 58, i.e., modular assemblies 58*a*, 58*b* and 58*c*, are secured together as a single unit. In this embodiment, the three modular assemblies 58*a*, 58*b* and 58*c* are positioned adjacent to each other and/or secured together. As shown in FIG. 9, the modular assemblies 58*a*, 58*b* and 58*c* may be different sizes, i.e., have different dimensions and shapes, as shown in the illustrated embodiment or one or more of the modular assemblies may have the same dimensions and shapes. Further, the modular assemblies 58*a*, 58*b* and 58*c* may be secured together at a remote location and transported to a site or modular assemblies may be individually transported to and secured at the site. Also, one or more of the modular assemblies 58*a*, 58*b* and 58*c* may have one or more open sides or openings, and/or a finished interior wall as described above. It should be appreciated that the sub-grade panels 60 are preferably four foot by eight foot panels and have a thickness of ⅝ (0.625) inches to one (1.0) inch, but may have any suitable dimensions and thickness. Also, the panels 60 may be positioned vertically or horizontally on the modular frame, such as panels 60*a* and 60*b*, and may be cut to be any suitable size or shape needed to cover the exterior of the modular frame.

While particular embodiments of the present modular assembly have been described herein, it will be appreciated by those skilled in the art that changes and modifications may be made thereto without departing from the invention in its broader aspects and as set forth in the following claims.

The invention claimed is:

1. A modular assembly for below-grade, comprising:

a modular frame to be installed at least partially below grade; and a single layer of cementitious panels solely attached to an outer side of said modular frame to form an outermost side of the modular assembly, at least two of said cementitious panels being attached to a common outer side of said modular frame, said cementitious panels being configured to withstand direct lateral, vertical and shear forces generated by surrounding below grade materials, wherein each of said cementitious panels is configured to withstand a uniform lateral load of up to 2083 pounds per square foot and have a shear strength of up to 1726 pounds per linear foot, wherein said cementitious panels each have a thickness of 0.625 inches to 1.0 inches, and wherein said modular frame and said plurality of cementitious panels are joined together as a unit prior to installation.

2. The modular assembly of claim 1, wherein said modular frame includes a plurality of primary structural supports and a plurality of secondary structural supports attached between upper and lower ends of said primary structural supports.

3. The modular assembly of claim 2, wherein at least one of said plurality of primary structural supports is made of iron or wood.

4. The modular assembly of claim 2, wherein at least one of said plurality of secondary structural supports is made of steel or wood.

5. The modular assembly of claim 1, further comprising a finished wall installed on an interior surface of said modular frame.

6. The modular assembly of claim 5, wherein said finished wall includes wallboard panels.

7. The modular assembly of claim 1, further comprising one of a waterproof coating or a waterproof membrane applied to an exterior surface of said modular frame.

8. The modular assembly of claim 1, wherein said modular frame includes at least one open side.

9. A modular system for below-grade installation and configured to support a multi-story building, the system comprising:

at least two modular assemblies secured together as a unit, each of said modular assemblies configured to be installed at least partially below grade, and including:

a modular frame;

a single layer of fiber-glass reinforced, moisture resistant cementitious panels solely attached to an outer surface of said modular frame to form an outermost side of the modular frame, at least two of said cementitious panels being attached to a common outer side of said modular frame, said cementitious panels being configured to withstand direct lateral, vertical and shear forces generated by surrounding below grade materials wherein each of said cementitious panels is configured to withstand a uniform lateral load of up to 2083 pounds per square foot and have a shear strength of up to 1726 pounds per linear foot, wherein said cementitious panels each have a thickness of 0.625 inches to 1.0 inches; and wherein said modular frame and said cementitious panels are joined together as a unit prior to installation.

10. The system of claim 9, wherein each of said at least two modular assemblies has a different size and shape.

11. The system of claim 9, wherein at least one of said at least two modular assemblies has a side with an opening.

12. The system of claim 9, wherein at least one of said at least two modular assemblies has an open side.

13. A method of forming a modular assembly for installation below grade and configured for supporting a building, the method comprising:

attaching a single layer of fiber-glass reinforced cementitious panels solely to an outer surface of a modular frame at a remote location, at least two of said fiber-glass reinforced cementitious panels being attached to a common outer side of said modular frame to form an outermost side of the modular assembly, said fiber-glass reinforced cementitious panels being configured to withstand direct lateral, vertical and shear forces generated by surrounding below grade materials, wherein each of said plurality of fiber-glass reinforced cementitious panels is configured to withstand a uniform lateral load of up to 2083 pounds per square foot and have a shear strength of up to 1726 pounds per linear foot; wherein said cementitious panels each have a thickness of 0.625 inches to 1.0 inches.

14. The method of claim 13, further comprising installing a finished wall on an interior surface of said modular frame.

15. The method of claim 13, further comprising applying one of a waterproof coating or a waterproof membrane to an exterior surface of said plurality of fiber-glass reinforced cementitious panels.

16. The modular assembly of claim 1, wherein said cementitious panels are fiber-glass reinforced cementitious panels.

* * * * *